US006823580B2

(12) United States Patent
Hofsäss

(10) Patent No.: US 6,823,580 B2
(45) Date of Patent: Nov. 30, 2004

(54) METHOD OF PRODUCING A TEMPERATURE-DEPENDENT SWITCH WITH STAMPED-ON ADHESIVE LAYER

(76) Inventor: Marcel Hofsäss, Höfener Strasse 29, Neuenbürg (DE)

( * ) Notice: Subject to any disclaimer, the term of this patent is extended or adjusted under 35 U.S.C. 154(b) by 0 days.

(21) Appl. No.: 10/092,057

(22) Filed: Mar. 5, 2002

(65) Prior Publication Data

US 2002/0145502 A1 Oct. 10, 2002

(30) Foreign Application Priority Data

Mar. 6, 2001 (DE) ..... 101 10 562

(51) Int. Cl.[7] ..... H01H 11/00; H01H 11/02; H01H 11/04; H01H 65/00

(52) U.S. Cl. ..... 29/622; 29/831; 29/DIG. 1; 156/293; 337/333

(58) Field of Search ..... 29/622, 623, 831, 29/835, DIG. 1; 156/292, 293, 305; 337/333, 343, 380

(56) References Cited

U.S. PATENT DOCUMENTS

| | | | | |
|---|---|---|---|---|
| 3,304,397 A | | 2/1967 | Bernhagen | 200/302.1 |
| 4,622,739 A | * | 11/1986 | Pejouhy et al. | 29/622 |
| 5,013,871 A | * | 5/1991 | Mahulikar et al. | 174/52.4 |
| 5,864,278 A | | 1/1999 | Becher | 337/380 |
| 5,877,671 A | | 3/1999 | Hofsass | 337/343 |
| 5,892,429 A | * | 4/1999 | Hofsass | 337/377 |
| 5,973,587 A | * | 10/1999 | Hofsass | 337/377 |
| 6,136,128 A | * | 10/2000 | Chung | 156/235 |

FOREIGN PATENT DOCUMENTS

| | | |
|---|---|---|
| DE | 15 15 516 B | 10/1965 |
| DE | 41 39 091 A1 | 8/1993 |
| DE | 296 05 048 U1 | 6/1996 |
| DE | 196 09 310 A1 | 9/1997 |
| DE | 196 23 570 A1 | 1/1998 |
| DE | 197 54 158 A1 | 5/1999 |
| DE | 197 57 023 A1 | 6/1999 |
| EP | 0 494 117 A1 | 7/1992 |

OTHER PUBLICATIONS

U.S. patent application Ser. No. 09/176,179.

* cited by examiner

*Primary Examiner*—A. Dexter Tugbang
*Assistant Examiner*—Donghai D. Nguyen
(74) *Attorney, Agent, or Firm*—Harness, Dickey & Pierce, P.L.C.

(57) ABSTRACT

For producing a temperature-dependent switch, which has a temperature-dependent switching mechanism which is accommodated in a housing and, depending on its temperature, establishes an electrically conducting connection between at least two connection electrodes arranged on the outside of the housing, the switching mechanism is placed in a lower part of the housing, the lower part is closed off with a cover part while forming at least one join, an adhesive layer is stamped on near the join in order to seal the join, and the adhesive layer is allowed to cure.

7 Claims, 3 Drawing Sheets

METHOD OF PRODUCING A TEMPERATURE-DEPENDENT SWITCH WITH STAMPED-ON ADHESIVE LAYER

BACKGROUND OF THE INVENTION

1. Field of the Invention

The present invention relates to a temperature-dependent switch with a temperature-dependent switching mechanism which is accommodated in a housing and, depending on its temperature, establishes an electrical connection between at least two connection electrodes provided on the outside of the housing, the housing having a lower part and a cover part, closing the latter while forming at least one join.

The invention also relates to a process for producing a temperature-dependent switch of this type.

2. Related Prior Art

Such temperature-dependent switches and processes for producing them are extensively known from the prior art.

The known temperature-dependent switches are used as safety elements which protect electrical devices from overheating and/or excessive power consumption. For this purpose, the temperature-dependent switches are electrically connected in series with the device to be protected, so that the operating current flows through the temperature-dependent switch. The switches are in this case arranged in heat-conducting connection with the device to be protected, so that the temperature of the latter is transferred to the switch.

Arranged in the switch is a bimetallic switching mechanism, which, depending on its temperature, establishes or interrupts an electrical connection between two connection electrodes on the housing of the switch. If there is too high a temperature or an excessive current flow, the temperature-dependent switch consequently breaks the current flow to the device to be protected, which can then cool down again and is protected from being damaged, respectively.

Temperature-dependent switches of this type are used, for example, in hot plates, hair dryers etc., but they are also encountered in particular as safety elements in transformers, motors, pumps, etc. To achieve good thermal coupling to the windings to be protected in these cases, the switches are frequently also wound into the coils and subsequently undergo the same further treatment steps as the coils, which are to be found for example in the transformers, motors, pumps, etc.

With respect to the construction, temperature-dependent switches of this type have a lower part and a cover part, it being possible for these housing parts to be produced from metal or from insulating material. If both housing parts are produced from metal, an insulating layer is provided between them, it then being possible for the lower part or the cover part to serve directly as a connection electrode, to which connecting leads can then be soldered. If only one of the two housing parts is of metal and the other is of insulating material, the metal housing part serves directly as the connection electrode, while a separate connection electrode, which may be a crimping lug protruding out of the housing part or else a solder head of a rivet penetrating through the housing part, is attached to the housing part of insulating material. If both housing parts are produced from insulating material, two separate connection electrodes are correspondingly required.

It is also known to provide both connection electrodes on the same housing part, that is for example on the cover part or on the lower part, which by means of a kind of current bridge can then be brought into connection with each other in temperature-dependent fashion by the temperature-dependent switching mechanism.

During the assembly of temperature-dependent switches of this type, the temperature-dependent switching mechanism is placed into the lower part, which is then closed by the cover part. This generally takes place by an upstanding edge of the lower part being flanged, if the lower part is produced from metal, or hot-pressed, if the lower part consists of insulating material. It is also known to push the cover part and lower part into each other and connect them to each other by means of snap-fittings.

The connecting point between the lower part and the cover part in this case represents a join, which may give rise to sealing problems. This is so because the temperature-dependent switches are often used in dusty or damp surroundings, so that it is necessary to prevent dust and moisture from penetrating into the interior of the switch and impairing its function. In addition, these switches must have a corresponding dielectric strength, since it is possible for the switches to carry great voltages, which must not lead to breakdown of the switch in the region of the join.

In the prior art, various possibilities are described for optionally sealing, at the customer's request, temperature-dependent switches subjected to corresponding loading.

The process customary among manufacturers of switches of this type is such that these switches are produced along with their connection hardware, that is the soldered-on connecting leads or other supply leads, before certain lots of the switches made up in this way are then provided with a special seal.

DE 196 09 310 A1 discloses a temperature-dependent switch in which the lower part is produced from insulating material and the cover part is produced from metal. The sealing between the lower part and the cover part takes place by means of a hot-pressed edge. In day-to-day operation, it has been found that this hot-pressed edge often does not provide the required tight seal with respect to dust and moisture.

DE 196 23 570 A1 discloses a temperature-dependent switch in which the lower part and cover part are produced from metal, with a Kapton film between these two housing parts being intended to provide not only the required electrical insulation but also the tight seal with respect to dust and moisture. For this purpose, a drawn-up edge of the lower part is flanged around the cover part. Here, too, it has been found that, with these and comparable switches with a flanged edge, under certain conditions the seal is not adequately tight even if an insulating film is provided.

DE 41 39 091 A1 discloses a temperature-dependent switch which, to increase the dielectric strength and to provide protection from dust and moisture, is fully encapsulated or enclosed in resin, sealing with a single-component thermosetting material taking place in a very complex process at least in the region of the connection electrodes provided with connection lugs.

Finally, DE 197 54 158 A1 also discloses the complete surrounding of a temperature-dependent switch with a shrink-fitted cap, from which the connecting leads protrude. The pushed-on shrink-fitted cap is hot-pressed or adhesively bonded.

The costs for the various subsequent treatment operations, described thus far, on switches which have already been made up lie in the range of 5% of the overall production costs, it even being possible under some circumstances for these costs to be higher still if shrink-fitted caps are used.

One disadvantage of sealing processes of this type is that the geometry of the switches changes as a result, they become more bulky and shapeless, it also being possible for the shrink-fitted caps to produce sharp edges and corners. This is disadvantageous in particular during winding into windings, because, on the one hand, very much more space than the space corresponding to the volume of the actual switch is required and, on the other hand, there is the risk of damage to the wires of the windings. In the case of the known processes, in some cases the geometry of the switch must also be designed specifically for the subsequent resin treatment, in order to create an appropriate bearing surface for the resins. Immersion processes, in which the switches are completely immersed in an immersion bath with encapsulating material, are in fact also known for this; although immersion is technologically more simple, it is disadvantageous that the switches encapsulated in this way require a lengthy drying time. In the case of an epoxy encapsulation after the connecting leads have been soldered on, there is also the risk that the unavoidable manipulations of the connecting leads during the installation of the switch will cause cracks in the encapsulation, so that a breach in the seal is produced and, for example, impregnating varnish can indeed get in.

SUMMARY OF THE INVENTION

In view of the above, it is an object of the present invention to provide a temperature-dependent switch of the type mentioned at the outset with a seal which is reliable, simple and can be inexpensively produced.

In the case of the switch mentioned at the outset, this object is achieved by the provision of an adhesive layer stamped on in the region of the join and sealing the latter.

In a process for producing a temperature-dependent switch of this type, which has a temperature-dependent switching mechanism which is accommodated in a housing and, depending on its temperature, establishes an electrically conducting connection between at least two connection electrodes arranged on the outside of the housing, the following steps are correspondingly carried out:

- placement of the switching mechanism in a lower part of the housing,
- closing of the lower part with a cover part while forming at least one join,
- stamping on of an adhesive layer in the region of the join in order to seal the join, and
- allowing the adhesive layer to cure.

The object underlying the invention is completely achieved in this way.

This is because the inventor of the present application has recognized that it is surprisingly possible to stamp adhesives onto the temperature-dependent switch in the region of the join and in this way provide a very good seal of the join. The stamping process achieves the effect that only a very small amount of adhesive is specifically pressed on only in the region of the join, so that the connection electrodes remain free for a subsequent connection of supply leads, which can then be manipulated during the installation of the switch without it being possible for the seal to be damaged.

Consequently, the invention surprisingly takes precisely the opposite approach than that described in the prior art. This is so because, as it were, semifinished products are initially sealed, before the making-up operation is carried out by means of the respectively desired connection technique. One of the effects of this is a great time saving, since it is no longer necessary for the switches already provided with connecting leads or other supply leads to be sealed, but instead it is merely necessary to provide in automatic production machines, even of existing switches, a further station in which the semi-finished products are stamped with adhesive, which then provides sealing of the at least one join.

In the case of the novel switch and the novel process, it is also advantageous that only so little adhesive is applied to the switch that its dimensions are virtually unchanged. In addition, it is advantageous that the switches can be produced very inexpensively. This is because, in the course of production, the seals can be provided in the usual cycle of the automatic production machine, so that now—if desired by the manufacturer—all the temperature-dependent switches can be reliably sealed, irrespective of whether these switches actually require this sealing later during their use. The switches sealed in this way can then be stored as semifinished products and, depending on the requirements of the customer, provided with connecting leads or other supply leads. In this way, not only is stockkeeping simplified, but advantages in sales arise.

Altogether, the novel switch is consequently not only more cost-effective, it can also be produced more quickly and is technically more reliable.

In an improvement, it is preferred in the novel process if the switch is heated before the stamping on of the adhesive layer and, furthermore, is preferably heated up after the stamping on of the adhesive layer, in order to cure the adhesive layer.

The heating of the switch before the stamping on of the adhesive layer has the advantage that the adhesive, as it were, becomes less viscous on contact with the switch, so that it flows more easily into the join. The curing can be performed not only by heating but also by irradiation with infrared or UV light. A separate curing zone in the automatic production machine has the advantage here that the adhesive cures quickly and in a defined manner before it runs in an uncontrolled manner on the or into the temperature-dependent switch.

It is further preferred if the adhesive layer is applied with a stamp which deforms elastically when it presses onto the switch, the stamp preferably being deformed in such a way that it presses the adhesive taken up on its end face into the join.

The preferably asymmetric elastic deformation of the stamp brings about a simple adaptation to the cross-sectional geometry of the switch, so that the adhesive can be reliably applied in the target area. If in this case it is ensured at the same time that the stamp presses the adhesive into the join, a pumping action is achieved thereby, providing very reliable application of the adhesive in the region of the join.

It goes without saying that it is possible to work on a temperature-dependent switch with a stamp from above and with a stamp from below in a single operation, so that different joins are provided with adhesive in one operation, before the adhesive is then cured in the next operation.

In this case, it is further preferred if the adhesive layer is applied with a stamp which has an end face adapted in its circumferential and/or cross-sectional contour to the join.

Here it is advantageous that, as it were, an uninterrupted surface adapted to the join can be provided with adhesive with a single stamp, so that there are no points of attachment where adhesive must be applied once again in a second procedure.

It is further preferred if, for taking up adhesive, the stamp is dipped with its end face into a supply container, which is preferably a squeegee tray, which is filled to a defined height with adhesive before the stamp is dipped in.

In the case of this measure, it is advantageous that always the same amount of adhesive is taken out of the squeegee tray and applied to the temperature-dependent switch, so that the amount of adhesive is sufficiently well-defined.

Such a transfer of adhesive in a similar manner is known in another area of technology. This is the SMD technique, in which small components are adhesively attached to the upper side of a printed circuit board. This adhesive is spread out smoothly in a supply bed, so that it has approximately a layer thickness of 200 to 300 $\mu$m. A metal stamp is then dipped into the bed of adhesive and takes approximately half the thickness of the adhesive with it when it is pulled out. When the metal stamp is pressed onto the substrate, again approximately half the adhesive remains adhering there. By contrast with the known process, in the novel process, however, an elastic stamp is used, the amount of adhesive being delivered in a defined manner in the region of a join, which is sealed as a result.

Finally, it is also preferred if, after the curing of the adhesive layer, supply leads are connected to the connection electrodes.

As already mentioned, it is advantageous here that all the production steps can initially be carried out on the temperature-dependent switch itself, before the connection technique then takes place, which can also be performed at the manufacturer for example in the case of the production of motors, pumps or the like, so that reliably sealed temperature-dependent switches in the form of semifinished products are made available by the invention.

In the case of the novel switch, it is further preferred if it is produced by the novel process.

Further advantages emerge from the description and the attached drawing.

It goes without saying that the features stated above and still to be explained below can be used not only in the combination respectively specified but also in other combinations or on their own without departing from the scope of the present invention.

BRIEF DESCRIPTION OF THE DRAWINGS

The invention is represented in the drawing and is explained in more detail in the following description. In the drawing.

DETAILED DESCRIPTION OF A PREFERRED EMBODIMENT

Figure 1:
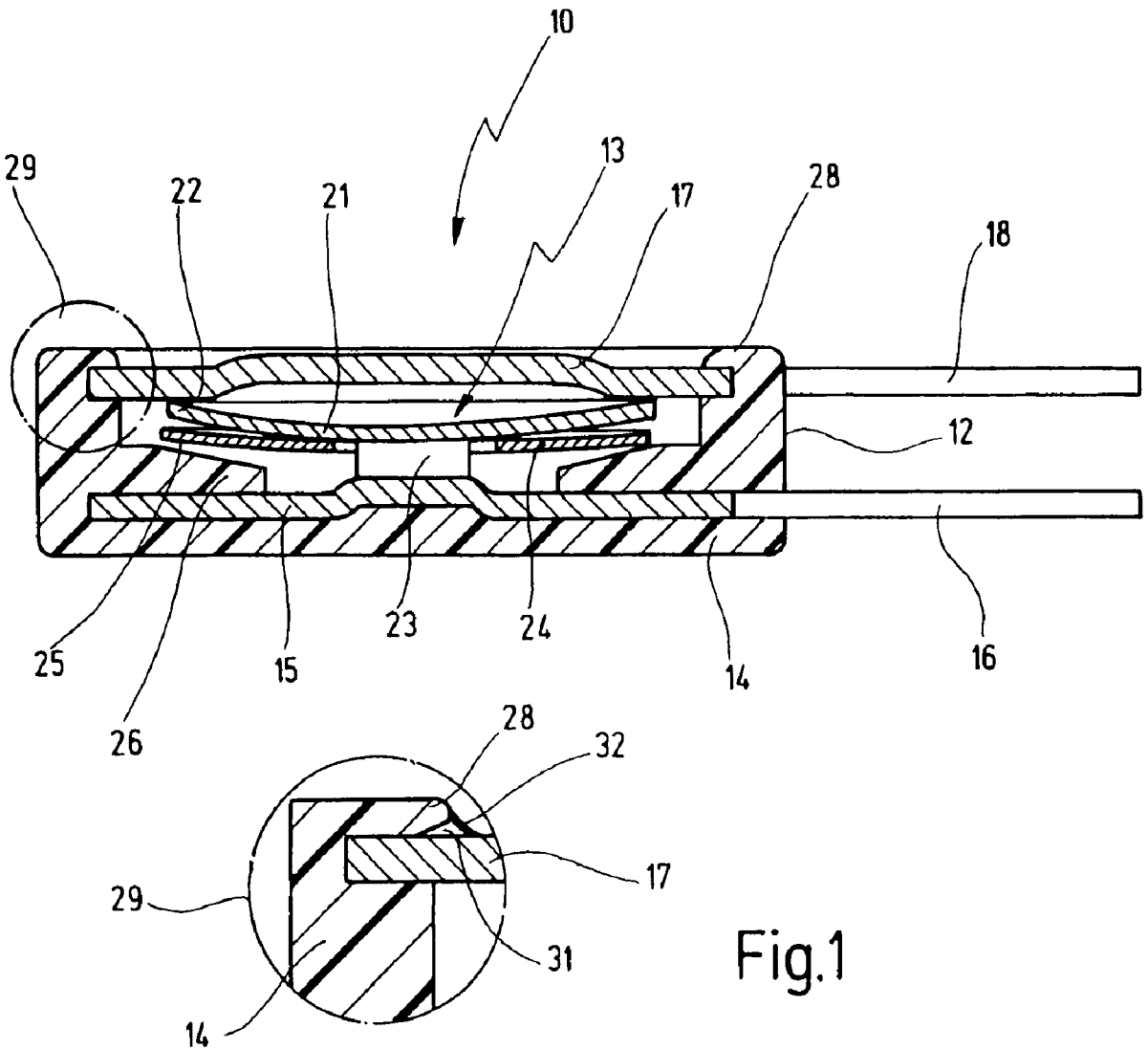
FIG. 1 shows the novel switch in a schematic sectional representation from the side.

In FIG. 1, 10 denotes a temperature-dependent switch, which has a housing 12, in which a temperature-dependent switching mechanism 13 is arranged.

A lower part 14 of the housing 12 is provided with an electrically conducting bottom electrode 15, from which a connection electrode 16 extends from the lower part 14, produced from insulating material. Furthermore, a cover part 17 of metal is provided, on which a connection electrode 18 is integrally provided.

The temperature-dependent switching mechanism 13 arranged in the lower part 14 comprises a spring disk 21, which is supported by its edge 22 on the inside of cover part 17. Approximately in the center, the spring disk 21 bears a movable contact 23, which, in the switching position shown in FIG. 1, is in bearing contact with the bottom electrode 15. In this way, the spring disk 21 establishes an electrically conducting connection from the connection electrode 18 via the cover part 17, the movable contact 23 and the bottom electrode 15 to the connection electrode 16.

Slipped over the movable contact 23 is a bimetallic snap-action disk 24, which, in the switching position shown in FIG. 1, is free of forces. If the temperature of the switch 10, and consequently of the bimetallic snap-action disk 24, increases above its response temperature, the bimetallic snap-action disk 24 snaps from the convex form shown into a concave form, in which its edge 25 is supported on an insulating region 26 of the lower part 14 and thereby lifts the movable contact 23 off the bottom electrode 15 against the force of the spring disk 21. In this way, the electrical connection between the two connection electrodes 16, 18 is interrupted when the response temperature of the bimetallic snap-action disk 24 is exceeded. If the temperature is lowered again, the bimetallic snap-action disk 24 snaps back again into its position shown in FIG. 1, so that the connection between connection electrodes 16 and 18 is re-established.

The cover part 17 is firmly connected to the lower part 14 by a peripheral edge of the latter indicated at 28. The peripheral edge 28 is created by hot-pressing from an upstanding edge of the lower part 14, as described in more detail in DE 196 09 310 A1, mentioned at the outset.

At 29 in FIG. 1, the transition between the edge 28 and the cover part 17 is represented in an enlarged form. In the detail 29, it can be seen that a join 31, which in cross section has the shape of a recumbent V, is formed between the cover part 17 and the edge 28. This join 31 is then sealed according to the invention by an adhesive layer 32, so that neither moisture nor dust can get into the temperature-dependent switch 10.

Figure 2:
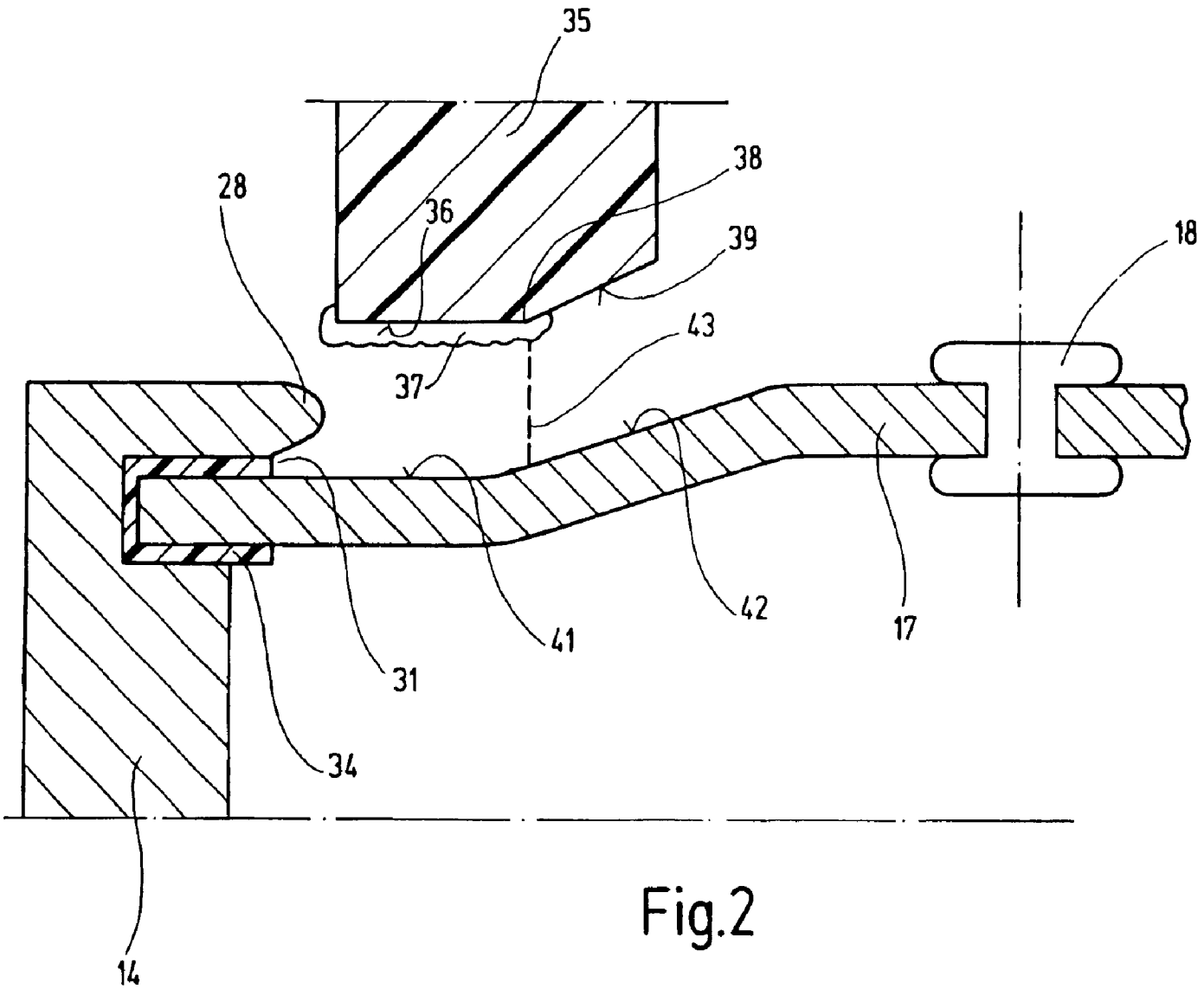
FIG. 2 shows in a further embodiment a novel switch in an enlarged detail in the region of the join.

The way in which the adhesive layer 32 is stamped onto the temperature-dependent switch 10 is now discussed in connection with FIG. 2, where an embodiment in which both the lower part 14 and the cover part 17 are produced from metal is shown in a further enlarged representation of the detail 29. To provide adequate electrical insulation between the lower part 14 and the cover part 17, an insulating layer 34 is provided, as known for example from DE 196 23 570 A1, mentioned at the outset, with a Kapton film being used for the sealing.

For sealing the join 31, the adhesive layer 32 which can be seen in FIG. 1 is now stamped onto the cover part 17 in the region of the join 31, using a stamp 35.

The stamp 35, shown in cross section and having an uninterrupted, circular end face 36, bears on this end face 36 a small amount of adhesive 37. The way in which the stamp 35 takes up this amount of adhesive 37 is explained further below in connection with FIG. 3.

The end face 36 goes over into a likewise peripheral bevel 39, while forming an edge 38, so that the stamp 35 has approximately a cross-sectional contour and a circular end face 36, that is peripheral contour, like the cover part 17.

The stamp 35 is then moved onto the cover part 17 in the region of its planar upper side 41 alongside the join 31, the edge 38 first coming into contact with a beveled face 42 of the cover part adjoining the planar upper side 41. As the stamp 35, which consists of elastic material such as rubber for example, is further pressed on, the edge 38 then deforms in such a way that the asymmetrically deforming stamp 35 adapts itself to the join 31 and the adhesive 37 is, as it were, pumped into the join 31. The path which the edge 38 is moving along when the stamp 35 is pressed on is indicated by a dashed line 43.

Once the adhesive 37 has been stamped onto the temperature-dependent switch 10 in this way, the stamp 35 is drawn back, with the greater part of the adhesive 37 remaining on the switch 10. The surface properties are in this case chosen such that the adhesion between the adhesive 37 and the end face 36 is at least not greater, but preferably less, than the adhesion between the adhesive 37 and the upper side 41 of the cover part 17.

Any epoxy resin may be used as the adhesive, a two-component adhesive being preferably used.

Figure 3:
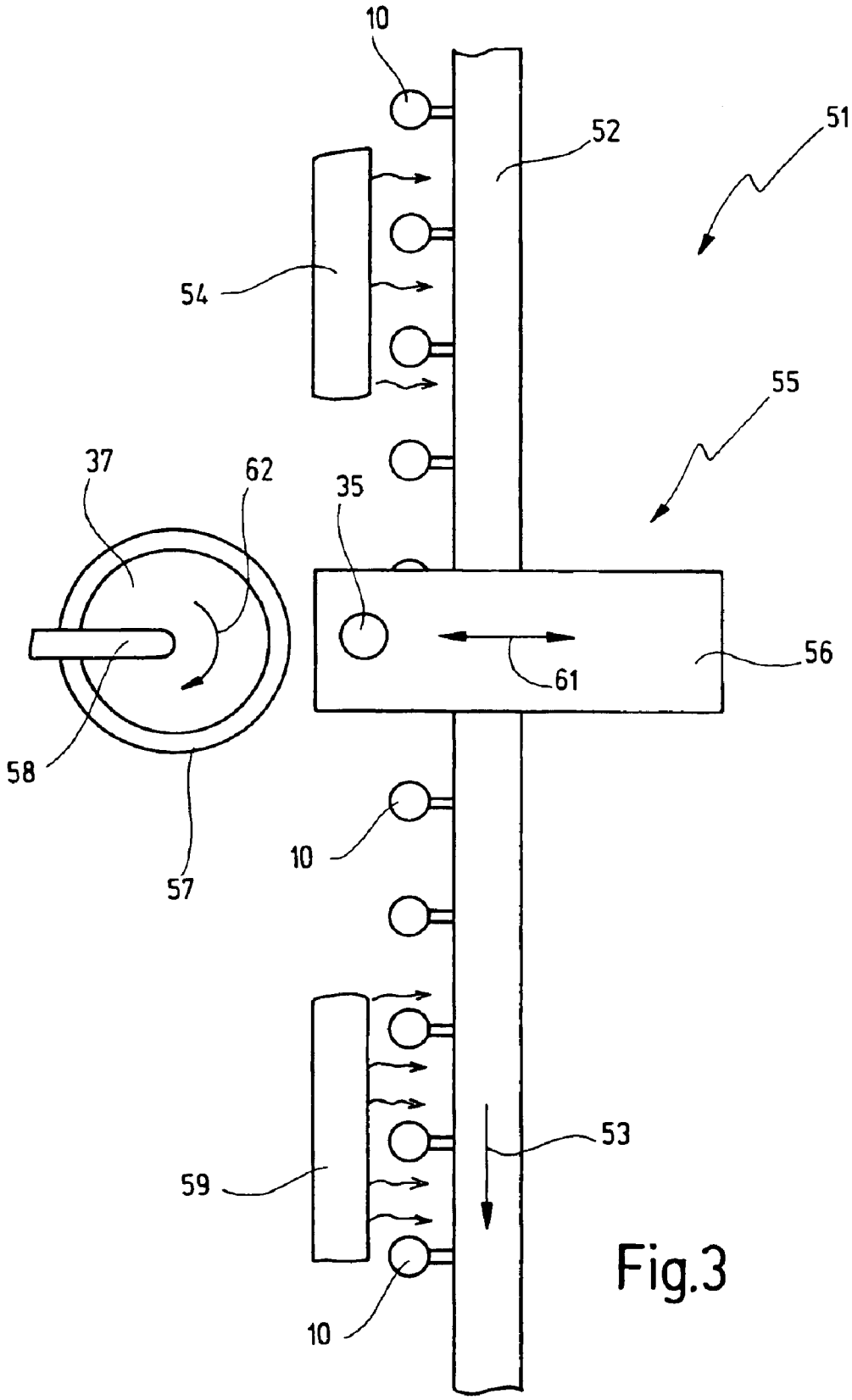
FIG. 3 shows in a schematic plan view the detail of an apparatus for producing the novel switch.

In FIG. 3, an apparatus 51 with which temperature-dependent switches 10 can be produced is now shown in the form of a detail.

The switches 10 are passed in a cyclical manner through the apparatus 51 on a belt 52 in the direction of an arrow 53. They come from above, for example from the station in which the peripheral edge 28 was hot-pressed or flanged.

Next, they run through a heating-up station, which is indicated at 54 and in which they are heated up to such a temperature that the adhesive becomes more viscous and flows easily into the join 31.

The heating-up station 54 is adjoined by a stamping station 55, in which there is provided a carriage 56, on which at least one stamp 35 is arranged. It goes without saying that it is possible to arrange a plurality of stamps 35 next to one another on the carriage 56, so that a plurality of temperature-dependent switches 10, which are also referred to as temperature monitors, can be sealed in a single working step.

Located in front of the carriage 56 is a squeegee tray 57, over which a squeegee 58 is arranged.

The stamping station 55 is adjoined by a heating station 59, in which the temperature monitors 10 are heated up to the temperature required for the curing of the adhesive. This may take place by UV irradiation, IR irradiation or contact heating.

At 61 it is also indicated how the carriage 56 can be moved in the stamping station 55.

It will be assumed hereafter that the carriage 56 is in the position shown in FIG. 3, in which the stamp 35 has delivered its adhesive to a temperature-dependent switch 10. The amount of adhesive 37 taken from the squeegee tray 57 is now fed into the squeegee tray 57, which is set in rotation for this purpose, as indicated at 62. As this happens, it is ensured by the squeegee 58 that a uniformly high layer of adhesive 37 is present in the squeegee tray 57.

The carriage 56 is now moved to the left in FIG. 3, so that the stamp 35 comes to lie over the squeegee tray 57, the rotation of which is now ended, so that it is stationary. The stamp 35 is then dipped into the adhesive 37 and out again, it taking up a defined amount of adhesive 37 by its end face 36. After that, the carriage 56 is moved to the right in FIG. 3, so that the stamp 35 assumes the position shown in FIG. 2 over a temperature-dependent switch 10. The stamp 35 is now moved onto the switch 10, so that the adhesive 37 comes into contact with the pre-heated switch 10. The adhesive thereby flows with the assistance of the pumping movement brought about by the elasticity of the stamp 35 into the join, where it then also remains when the stamp 35 is drawn back.

By moving the belt 52 cyclically along the arrow 53, the switch 10 imprinted with adhesive 37 in this way goes into the heating station 59, where the adhesive 37 is cured in a defined manner.

Subsequently, the temperature-dependent switch 10 is finished as a semifinished product; it can now either be provided with supply leads, in a next working step, or else be stored or sold to further-processing companies.

Therefore, what I claim, is:

1. A process for producing a temperature-dependent switch, which has a temperature-dependent switching mechanism which is accommodated in a housing and, depending on its temperature, establishes an electrically conducting connection between at least two connection electrodes arranged on the outside of the housing, comprising the following steps:

placement of the switching mechanism in a lower part of the housing, closing of the lower part with a cover part while forming at least one join, stamping on of an adhesive layer near the join in order to seal the join, whereby the adhesive layer is applied with a stamp which deforms elastically and asymmetrically when it presses onto the switch, and allowing the adhesive layer to cure.

2. A process for producing a temperature-dependent switch, which has a temperature-dependent switching mechanism which is accommodated in a housing and, depending on its temperature, establishes an electrically conducting connection between at least two connection electrodes arranged on the outside of the housing, comprising the following steps:

placement of the switching mechanism in a lower part of the housing, closing of the lower part with a cover part while forming at least one join, stamping on of an adhesive layer near the join in order to seal the join, whereby the adhesive layer is applied with a stamp which deforms elastically when it presses onto the switch, and wherein the stamp deforms in such a way that it presses the adhesive taken up on its end face into the join, and allowing the adhesive layer to cure.

3. The process as in claim 2, wherein the stamp which has an end face that is adapted in its contour to the join.

4. A process for producing a temperature-dependent switch, which has a temperature-dependent switching mechanism which is accommodated in a housing and, depending on its temperature, establishes an electrically conducting connection between at least two connection electrodes arranged on the outside of the housing, comprising the following steps:

placement of the switching mechanism in a lower part of the housing, closing of the lower part with a cover part while forming at least one join, stamping on of an adhesive layer near the join in order to seal the join, whereby the adhesive layer is applied with a stamp which deforms elastically when it presses onto the switch, and wherein, for taking up adhesive, the stamp is dipped with its end face into a supply container, and allowing the adhesive layer to cure.

5. The process as in claim 4, wherein the supply container is a squeegee tray, which is filled to a defined height with adhesive before the stamp is dipped in.

6. A process for producing a temperature-dependent switch, which has a temperature-dependent switching mechanism which is accommodated in a housing and, depending on its temperature, establishes an electrically conducting connection between at least two connection electrodes arranged on the outside of the housing, comprising the following steps:

placement of the switching mechanism in a lower part of the housing, closing of the lower part with a cover part while forming at least one join, stamping on of an adhesive layer near the join in order to seal the join, wherein the adhesive layer is applied with a stamp which has an end face adapted in its contour to the join, and wherein, for taking up adhesive, the stamp is dipped with its end face into a supply container, and allowing the adhesive layer to cure.

7. A process for producing a temperature-dependent switch, which has a temperature-dependent switching mechanism which is accommodated in a housing and, depending on its temperature, establishes an electrically conducting connection between at least two connection electrodes arranged on the outside of the housing, comprising the following steps:

placement of the switching mechanism in a lower part of the housing, closing of the lower part with a cover part while forming at least one join, stamping on of an adhesive layer near the join in order to seal the join, allowing the adhesive layer to cure, and wherein, after the curing of the adhesive layer, supply leads are connected to the connection electrodes.

* * * * *